US007614715B2

(12) United States Patent
Woods

(10) Patent No.: US 7,614,715 B2
(45) Date of Patent: Nov. 10, 2009

(54) MICRO-FLUID EJECTION HEAD HAVING ADAPTIVE THERMAL CONTROL

(75) Inventor: Gregory Scott Woods, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 265 days.

(21) Appl. No.: 11/759,260

(22) Filed: Jun. 7, 2007

(65) Prior Publication Data

US 2008/0303853 A1 Dec. 11, 2008

(51) Int. Cl.
*B41J 29/38* (2006.01)
*B41J 29/393* (2006.01)
*B41J 2/05* (2006.01)

(52) U.S. Cl. ..... 347/17; 347/14; 347/19; 347/60

(58) Field of Classification Search ..... 347/17, 347/60; 432/49
See application file for complete search history.

(56) References Cited

U.S. PATENT DOCUMENTS

2002/0055080 A1* 5/2002 Tanaka et al. ..... 432/49
2002/0149639 A1* 10/2002 Crivelli et al. ..... 347/17
2003/0081033 A1* 5/2003 Giere et al. ..... 347/17
2005/0052485 A1* 3/2005 Komatsu et al. ..... 347/17
2007/0153044 A1* 7/2007 Barkley et al. ..... 347/17
2007/0153045 A1* 7/2007 Barkley et al. ..... 347/17
2008/0062216 A1* 3/2008 Bergstedt et al. ..... 347/17

FOREIGN PATENT DOCUMENTS

JP 03218841 A * 9/1991

* cited by examiner

*Primary Examiner*—Matthew Luu
*Assistant Examiner*—Shelby Fidler
(74) *Attorney, Agent, or Firm*—Leudeka, Neely & Graham

(57) ABSTRACT

A method of controlling a micro fluid ejection device by sensing a middle zone temperature, and selectively applying an amount of power to a middle zone heater to achieve a target temperature. An edge zone temperature is also sensed and power is selectively applied to edge zone heaters to achieve a target temperature for the edge zones, whereby uniform ejection of fluid droplets along an ejector array may be achieved.

20 Claims, 3 Drawing Sheets

MICRO-FLUID EJECTION HEAD HAVING ADAPTIVE THERMAL CONTROL

TECHNICAL FIELD

The disclosure relates to the fluid of micro fluid ejection devices. More particularly, the disclosure relates to controlling the uniformity of fluid droplet formation along a substantially linear array of ejectors for a micro-fluid ejection head.

BACKGROUND AND SUMMARY

Micro-fluid ejection devices, such as devices used for ink jet printing and other micro-fluid ejection applications, have become extremely popular for a variety of reasons, including the relative simplicity of their design and lower cost when compared to other types of fluid ejection devices. In basic concept, micro-fluid ejection devices operate by supplying fluid to an ejection head that that may be operable to scan back and forth across a fluid receiving medium such as paper. The ejection head has a matrix of flow features, such as supply channels, fluid ejection chambers, and nozzles. The supply channels feed the fluid to the ejection chambers. The fluid ejection actuators in the ejection chambers impart energy to the fluid that is sufficient to induce the fluid to form a vapor bubble that propels the fluid from the ejection chamber through the nozzle and onto the fluid receiving medium. The element that imparts the energy to the fluid within the ejection chambers may take the form of a resistive heater or a piezoelectric device, for example.

The size and shape of a droplet of fluid that is ejected through the nozzle is determined by a combination of many factors. One factor is an amount of energy that is imparted to the fluid within the ejection chamber. A temperature of a in a vicinity of the ejection chamber tends to play a large role in this factor. In general, ejection chambers that are disposed on a portion of the substrate that is relatively hotter tend to expel fluid droplets that have properties that are different from those fluid droplets that are expelled from ejection chambers that are disposed in a relatively cooler portion of the substrate.

In current micro-fluid ejector designs, an entire ejector array portion of the substrate is heated to a single predetermined temperature. The temperature of the ejector array is typically determined by use of a temperature sensing device that is disposed along the ejector array. The temperature sensor is in communication with a means for heating the ejector array, such as through an external circuit that performs closed loop thermal control of the system. One problem with, this method is that the edges of the ejector array tend to be relatively cooler then the center of tire array. Such thermal gradient along the ejector array may cause fluid ejection problems, such as print detects in the case of ink jet print heads wherein a middle portion of a print swath may have a darker color then edges of the print swath.

One method that has been used to improve fluid ejection non-uniformity is to divide the ejection head into zones and apply separate temperature control to each zone. The zone method allows more heat to be applied to the edges of the ejector array, which helps to keep the edges of the array at the same temperature as the middle of the array. The foregoing design works well for non-jetting modes of operation (such as pre-swath heating) and heating during light fluid coverage of a medium. However, as soon as a swath with a high coverage density is provided, the zone heating design encounters problems. Such high-density swaths tend to cause the micro-fluid ejector substrate to rise above the target temperature. When the ejector array is above the target temperature, the temperature of the substrate can no longer be controlled, because there are no means provided by which heat is removed from the array, other than a natural dissipation of the heat. However, the natural dissipation of heat allows the edges of the ejector array to again become cooler than the middle of the array, which is the very condition that the zone heating was supposed to resolve.

What is needed, therefore, is a system that overcomes problems such as those described above, at least in part.

The above and other needs may be met by a method of controlling a micro fluid ejection device having at least a middle zone with an associated middle zone heater and an edge zone with an associated edge zone heater, where the middle zone is disposed relatively nearer a middle of the micro fluid ejection device substrate and the edge zone is disposed relatively nearer an edge of the micro fluid ejection device substrate. A middle zone epsilon temperature, a middle zone target temperature, a middle zone maximum temperature, an edge zone epsilon temperature, an edge zone target temperature, and an edge zone maximum temperature are specified.

A temperature in the middle zone is sensed to produce a middle zone temperature. Full middle zone power is applied to the middle zone heater when the middle zone temperature is below the middle zone epsilon temperature. Less than the full middle zone power is applied to the middle zone heater when the middle zone temperature is both above the middle zone epsilon temperature and below the middle zone target temperature, where the middle zone power applied is calculated to achieve the middle zone target temperature. No power is applied to the middle zone heater when the middle zone temperature is above the middle zone target temperature.

A temperature in the edge zone is sensed to produce an edge zone temperature. Full edge zone power is applied to the edge zone heater when the edge zone temperature is below the edge zone epsilon temperature. Less than the full edge zone power is applied to the edge zone heater when the edge zone temperature is both above the edge zone epsilon temperature and below the edge zone target temperature, where the edge zone power applied is calculated to achieve the edge zone target temperature. No power is applied to the edge zone heater when the edge zone temperature is above the edge zone maximum temperature.

When the edge zone temperature is both above the edge zone target temperature and below the edge zone maximum temperature, no power is applied to the edge zone heater when the middle zone temperature is below the middle zone target temperature, and less than the full edge power is applied to the edge zone heater when the middle zone temperature is both above the middle zone target temperature and below the middle zone maximum temperature, where the edge zone power applied is calculated to achieve the middle zone temperature.

In various embodiments according to this aspect of the exemplary embodiments, the edge zone epsilon temperature is equal to the middle zone epsilon temperature, the edge zone target temperature is equal to the middle zone target temperature, and the edge zone maximum temperature is equal to the middle zone maximum temperature. In some embodiments the micro fluid ejection device has only two edge zones and only one middle zone, and in other embodiments the micro fluid ejection device has multiple edge zones and multiple middle zones. Also described are a micro fluid ejection device having circuitry that implements the method described above, and a printer with a micro fluid ejection device having circuitry that implements the method.

According to another aspect of the exemplary embodiments there is described a micro field ejection device with at least one middle zone, where the middle zone is disposed relatively nearer a middle of the micro fluid ejection device substrate. A middle zone heater is associated with the middle zone, for heating the middle zone. A middle zone temperature sensor is also associated with the middle zone, for sensing a middle zone temperature. A middle zone controller controls a middle zone power that is applied to the middle zone heater based at least in part on the middle zone temperature. The middle zone controller has set points, including a middle zone epsilon temperature, a middle zone target temperature, and a middle zone maximum temperature. The middle zone controller has circuitry to, (1) apply a full middle zone power to the middle zone heater when the middle zone temperature is below the middle zone epsilon temperature, (2) apply less than the full middle zone power to the middle zone heater when the middle zone temperature is both above the middle zone epsilon temperature and below the middle zone target temperature, where the middle power applied is calculated to achieve the middle zone target temperature, and (3) apply no power to the middle zone heater when the middle zone temperature is above the middle zone target temperature.

The micro fluid ejection device has at least one edge zone, where the edge zone is disposed relatively nearer an edge of the micro fluid ejection device substrate. An edge zone heater is associated with the edge zone, for heating the edge zone. An edge zone temperature sensor is also associated with the edge zone, for sensing an edge zone temperature. An edge zone controller controls an edge zone power that is applied to the edge zone heater, based at least in part on the edge zone temperature. The edge zone controller has set points, including an edge zone epsilon temperature, an edge zone target temperature, and an edge zone maximum temperature. The edge zone controller has circuitry to, (1) apply a full edge zone power to the edge zone hearer when the edge zone temperature is below the edge zone epsilon temperature, (2) apply less than the full edge zone power to the edge zone heater when the edge zone temperature is both above the edge zone epsilon temperature and below the edge zone target temperature, where the edge zone power applied is calculated to achieve the edge zone target temperature, and (3) apply no power to the edge zone heater when the edge zone temperature is above the edge zone maximum temperature.

When the edge zone temperature is both above the edge zone target temperature and below the edge zone maximum temperature, the edge controller can (4) apply no power to the edge zone heater when the middle zone temperature is below the middle zone target temperature, and (5) apply less than the toll edge power to the edge zone heater when the middle zone temperature is both above the middle zone target temperature and below the middle zone maximum temperature, where the edge power applied is calculated to achieve the middle zone temperature.

BRIEF DESCRIPTION OF THE DRAWINGS

Further advantages of the exemplary embodiments may be apparent by reference to the detailed description when considered in conjunction with the figures, which are not to scale so as to more dearly show the details, wherein like reference numbers indicate like elements throughout the several views, and wherein.

DETAILED DESCRIPTION

Figure 1:
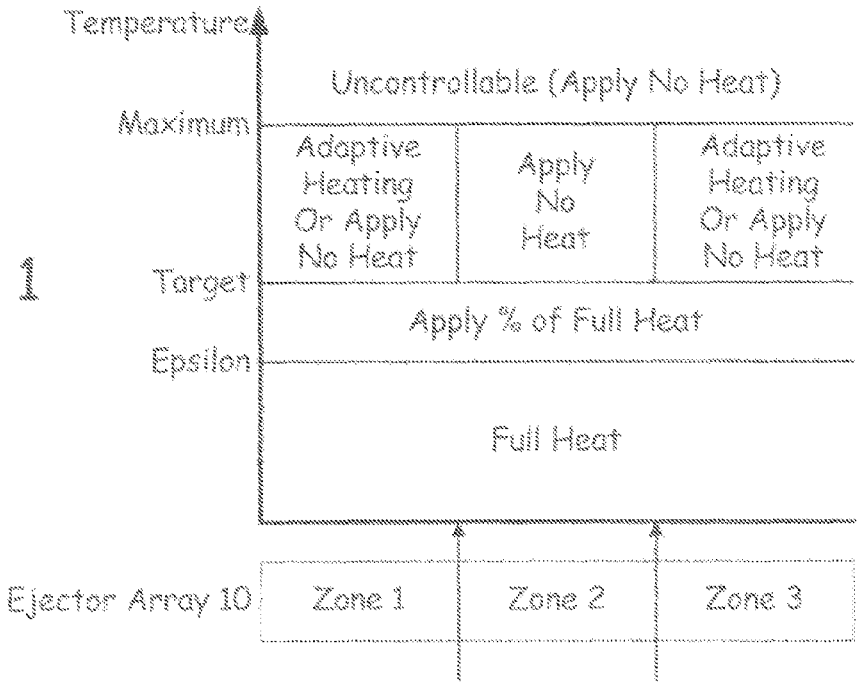
FIG. 1 depicts a heating algorithm for an ejector array according to a first embodiment of the disclosure.

With reference now to FIG. 1 there is depicted a heating algorithm for an ejector array 10 according to a first embodiment of the disclosure. At the bottom of FIG. 1 there is depicted a representation of the elector array 10 with three zones, 1, 2, and 3. These three zones represent a center (or middle) zone 2 and two edge zones 1 and 3. As depicted, these three zones may be a cross-section of an ejector array 10 that extends farther along an X axis (horizontal axis as shown), such as above and below the portions of the zones 1-3 as depicted, or the three zones as depleted may be the entire ejector array 10, with distal ends of the ejector array in zone 1 and zone 3.

Figure 3:
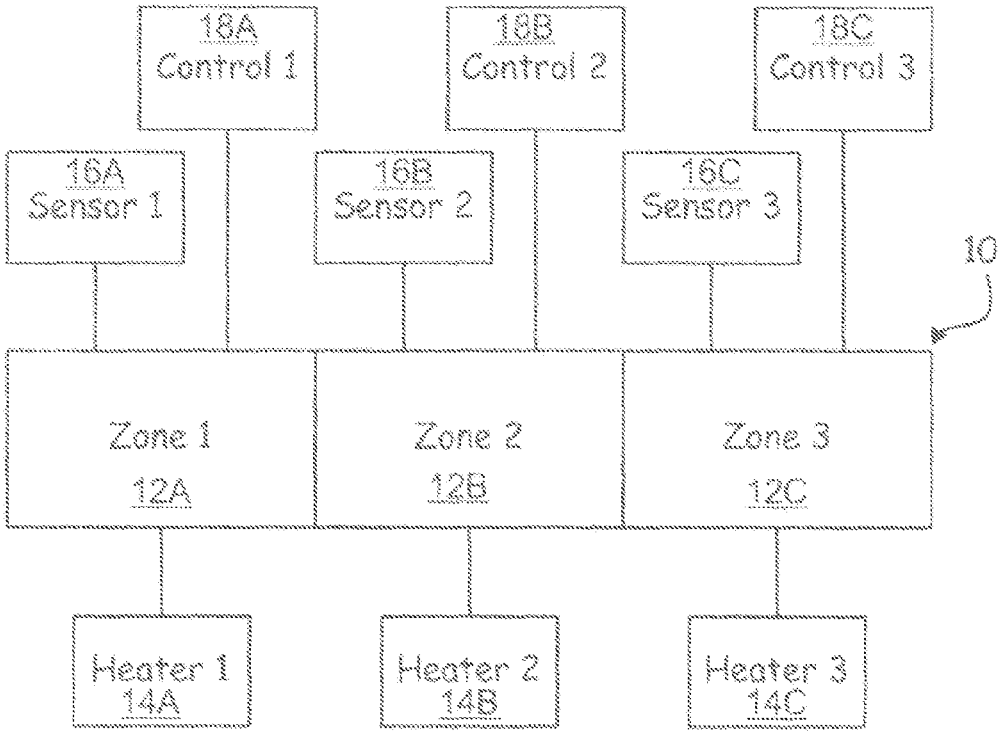
FIG. 3 is a functional block diagram of an ejector array according to one embodiment of the disclosure.

FIG. 3 provides more information in regard to the ejector array 10. As depicted in the functional block diagram of FIG. 3, each zone 12A, 12B, and 12C of the ejector array 10 has a zone heater 14A, 14B, and 14C, a zone sensor 16A, 16B, and 16C, and a zone temperature controller 18A, 18B, and 18C associated with the respective zone. In one embodiment, all of the zone heaters 14A, 14B, and 14C, sensors 16A, 16B, and 16C, and controllers 18A, 18B, and 18C are separate and independent from one another. In other embodiments, for example, a common controller is used to monitor and adjust the three temperatures in the three different zones 12A, 12B, and 12C. Some of the zones, such as the edge zones 12A and 12C, may be controlled concurrently.

Regardless of whether the zones am all completely independent in all aspects of their control or not, in basic implementation, the heater for each zone is operable to elevate the temperature of the associated zone, the sensor measures the temperature of the associated zone and reports the measured temperature to the temperature controller, and the temperature controller provides temperature control to the associated zone by increasing or decreasing the power applied to the respective zone heater. Thus, if the zone is below a desired temperature, the controller provides some or all available power to the associated heater. As the sensed temperature approaches the desired temperature, a lesser amount of power is applied to the heater so as to not inappropriately overshoot the desired temperature. If the sensed temperature is above the desired temperature, then in one embodiment, no power at all is applied to the heater, bat no active means are provided to cool the zone.

With reference once again to FIG. 1, there is depleted above the ejector array 10 a graph that describes the temperature control algorithm for the ejector array 10. The X axis of the graph indicates the position along the ejector array 10—or in other words the zone, and the Y axis of the graph indicates the temperature within a given zone. As can be seen, the graph is divided into regions, which are labeled with brief explanations of the control algorithm to be applied within those regions, as described in more detail below. The arrows that separate the zones 1-3 in the ejector array 10 also help differentiate the control regions in the graph above the depiction of the ejector array 10, and are provided as a convenience for understanding.

Along the Y axis of the graph are three temperature settings—epsilon, target, and maximum. In the embodiment depicted in FIG. 1, all three zones of the ejector array 10 have the same epsilon setting, the same target setting, and the same maximum setting. Below the epsilon setting, full power is applied to the heater by the controller, so as to raise the temperature of the zone. Above the epsilon setting, full power to the heater is no longer applied by the controller to a given zone of the ejector array 10. Instead, a control algorithm of some sort within the controller applies a percentage of the maximum power to the heater, so as to not unduly overshoot the target temperature.

The target temperature in one embodiment is the minimum desired operational temperature for that zone of the elector array 10. The maximum temperature in one embodiment is the maximum desired operational temperature for that zone of the ejector array. If the temperature of a given zone is either above the maximum temperature or below the target temperature, then in one embodiment, that zone of the ejector array 10 will not function in the optimum manner. For example, if a zone is too cool, the ejectors of the ejector array within that zone may produce fluid droplets that are too small and with an improper trajectory, and if a zone is too hot, the ejectors of the ejector array within that zone may produce fluid droplets that are too large and with an improper trajectory. Thus, the temperature controllers preferably function to keep the temperature of each zone of the ejector array between the target temperature and the maximum temperature.

In the embodiment depicted in FIG. 1, if the temperature within any zone is below the epsilon temperature, then full power is applied to the heater associated with that zone, regardless of the temperature in any other zone. Similarly, if the temperature within any zone is both above the epsilon temperature and below the target temperature, then some percentage of the power is applied to the heater associated with that zone, regardless of the temperature in any other zone. Finally, if the temperature within any zone is above the maximum temperature, then no power is applied to the heater associated with that zone, regardless of the temperature in any other zone.

However, when the temperature within a given zone is both above the target temperature and below the maximum temperature, then the algorithm used to control the temperature within the zone may vary from zone to zone. For example, if the temperature within zone 2—the middle zone—is both above the target temperature and below the maximum temperature, then in the embodiment depicted in FIG. 1, no power is applied by the controller to the heater associated with that zone.

The algorithm for zones 1 and 3, however, is different in this temperature range. When the temperature in either of zones 1 or 3—the edge zones—is both above the target temperature and below the maximum temperature, then power to the associated heaters is applied—or not—based upon additional criteria. In one embodiment, this additional criteria includes the temperature of an adjacent zone, or of a middle zone (if the adjacent zone is not a middle zone), or of all middle zones (if there is more than one middle zone), or some combination of other zones.

In one embodiment, if the temperature in either of zones 1 or 3—the edge zones—is both above the target temperature and below the maximum temperature, and the temperature of zone 2—the middle zone—is below the target temperature, then no power is applied to the heaters associated with the zone 1 or 3 for which the condition applies. In this case, the temperature is already controlled for proper operation within the edge zone, and the power applied to the heater for the middle zone—or the natural operation of the ejector array 10—will function to elevate the temperature of that zone to a predetermined operating temperature.

However, if the temperature in either of zones 1 or 3 is both above the target temperature and below the maximum temperature, and the temperature of zone 2 is both above the target temperature and below the maximum temperature, then the set point for the controller for the respective zone 1 or 3 is adjusted to the measured temperature of the middle zone, instead of the target temperature. If the temperature in the middle zone 2 is higher than the temperature in the edge zone 1 or 3, then some amount of power is applied to the heaters for that zone 1 or 3, to bring the temperature in the edge zone 1 or 3 to the same temperature as that in the middle zone 2. However, if the temperature in the middle zone 2 is below the temperature in the edge zone 1 or 3, then in one embodiment, no power is applied to the heaters in the edge zone 1 or 3. In either ease, all of the zones 1-3 are within an acceptable temperature range, and the power to the heaters in the edge zones is controlled to try to match the temperature in the edge zones with the temperature in the middle zone, thus enabling a more uniform fluid droplet ejection swath.

Figure 2:
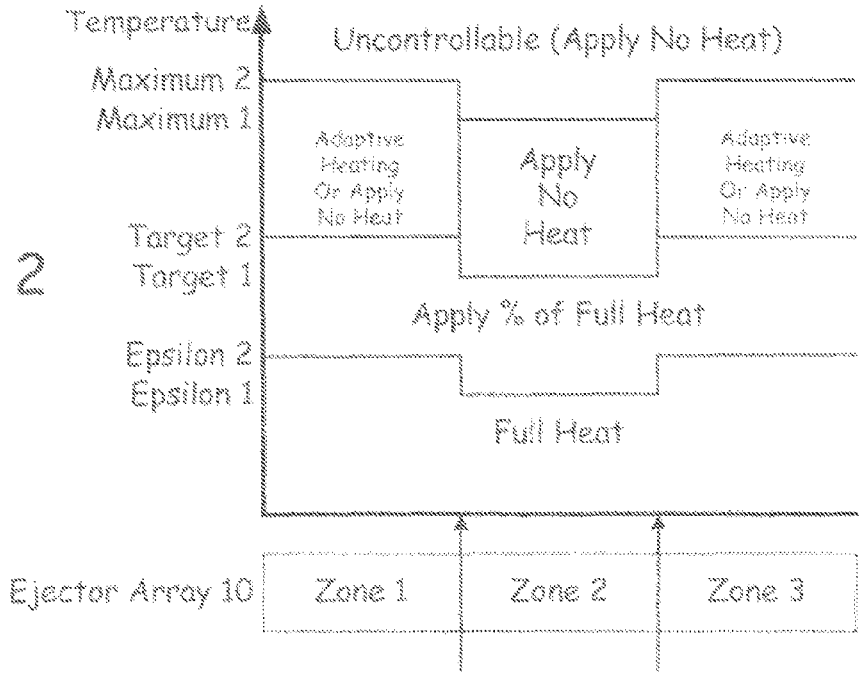
FIG. 2 depicts a heating algorithm for an ejector array according to a second embodiment of the disclosure.

As depicted in the embodiment of FIG. 2, the epsilon, target, and maximum temperature set points may be different for the different zones, such as for the edge zones versus the middle zones. In the embodiment depleted in FIG. 2, the various set points are at higher values for the edge zones. Such higher set point values tend to apply more heat to the edges zones, which as described above, tend to cool more rapidly than the middle zones. However, in other embodiments the set points for the edge zones might not be uniformly set at higher values than those for the middle zones. Similarly, all of the edge zones might not have the same set points, for a variety of different reasons. For example, one end of the ejector array 10 may cool faster than the other end, because of physical differences, air flow differences, or other conditions, and might therefore have different set points.

Further, it is appreciated that the ejector array 10 may have many more zones than just the three described and depicted, which are by way of example and not limitation. For example, an ejector array 10 may be divided into a five-by-five matrix of twenty-five zones, with sixteen edge zones and nine middle zones. The middle zones in one embodiment may all be controlled together as described above, and the edge zones may also all be controlled together, as described above. In another embodiment, all of the edge zones and all of the middle zones are independently controlled one from another, according to the principles generally described above in regard to the three-zone example, where less or no heat is applied to more centrally located zones, and more peripherally located zones are selectively and adaptively controlled to the temperature of one or more of the middle zones. Again, different set points, as depicted in FIG. 2, may also be applied in these embodiments.

Figure 4:
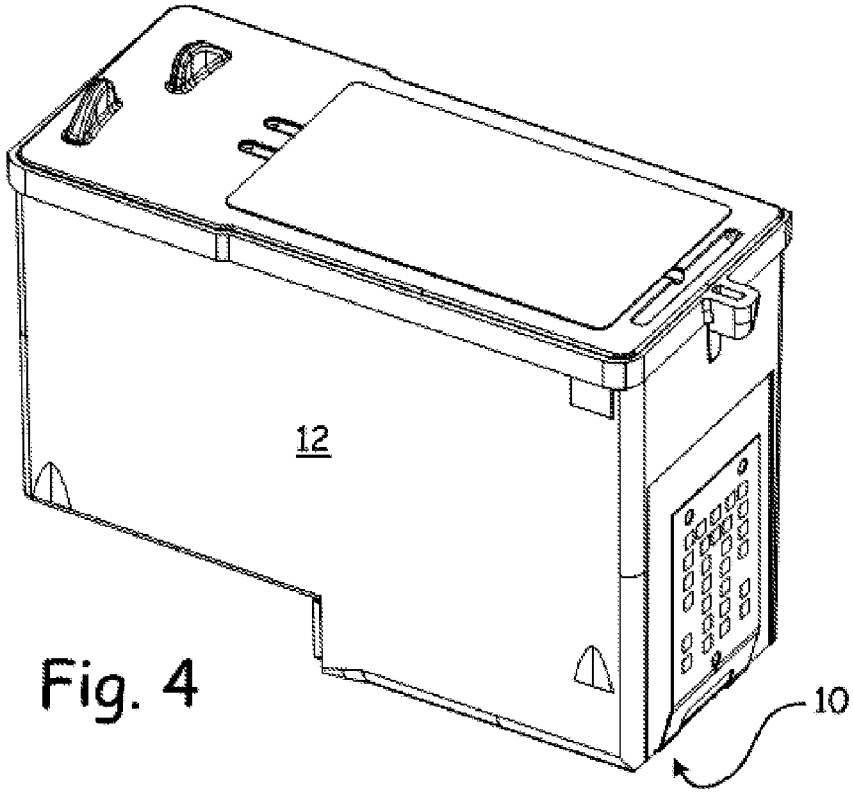
FIG. 4 depicts a fluid reservoir body including a micro fluid ejection head having an ejector array according to the disclosure.
Figure 5:
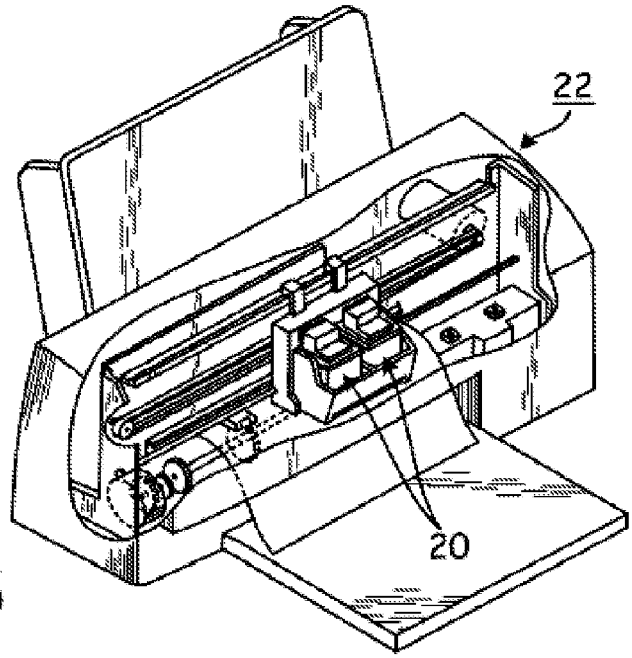
FIG. 5 depicts a printer including a fluid reservoir body including a micro-fluid ejection head having an ejector array according to the disclosure.

FIG. 4 depicts a fluid reservoir body 20 that includes an ejection head containing the ejector array 10 according to the exemplary embodiments described above. FIG. 5 depicts a micro-fluid ejection device, such as a printer 22 that includes the reservoir body 20 containing the ejection head with the elector array 10 according to the exemplary embodiments described above.

The foregoing description of exemplary embodiments has been presented for purposes of illustration and description. It is not intended to be exhaustive or to limit the disclosed embodiments to the precise form disclosed. Obvious modifications or variations are possible in light of the above teachings. The embodiments are chosen and described in an effort to provide the best illustrations of the principles of the exemplary embodiments and its practical application, and to thereby enable one of ordinary skill in the art to utilize the various embodiments and with various modifications as are suited to the particular use contemplated. All such modifications and variations are within the scope of the exemplary embodiments as determined by the appended claims when interpreted in accordance with the breadth to which they are fairly, legally, and equitably entitled.

What is claimed is:

1. A method of controlling a micro fluid ejection device having at least a middle zone with an associated middle zone heater and an edge zone with an associated edge zone heater, wherein the middle one is disposed relatively nearer a middle portion of a substrate for the micro fluid ejection device and the edge zone is disposed relatively nearer an edge portion of the substrate for the micro fluid ejection device, the method comprising:

specifying a middle zone epsilon temperature, a middle zone target temperature, and a middle zone maximum temperature, sensing temperature in the middle zone to produce a middle zone temperature, applying a full middle zone power to the middle zone heater when the middle zone temperature is below the middle zone epsilon temperature, applying less than the full middle zone power to the middle zone heater when the middle zone temperature is both above the middle zone epsilon temperature and below the middle zone target temperature, wherein the middle zone power applied is calculated to achieve the middle zone target temperature, applying no power to the middle zone heater when the middle zone temperature is above the middle zone target temperature, specifying an edge zone epsilon temperature, an edge zone target temperature, and an edge zone maximum temperature, sensing temperature in the edge zone to produce an edge zone temperature, applying a full edge zone power to the edge zone heater when the edge zone temperature is below the edge zone epsilon temperature, applying less than the full edge zone power to the edge zone heater when the edge zone temperature is both above the edge zone epsilon temperature and below the edge zone target temperature, wherein the edge zone power applied is calculated to achieve the edge zone target temperature, applying no power to the edge zone heater when the edge zone temperature is above the edge zone maximum temperature, and when the edge zone temperature is both above the edge zone target temperature and below the edge zone maximum temperature, applying no power to the edge zone heater when the middle zone temperature is below the middle zone target temperature, and applying less than the full edge zone power to the edge zone heater when the middle zone temperature is both above the middle zone target temperature and below the middle zone maximum temperature, wherein the edge zone power applied is calculated to achieve the middle zone temperature.

2. The method of claim 1, wherein the edge zone epsilon temperature is equal to the middle zone epsilon temperature.

3. The method of claim 1, wherein the edge zone target temperature is equal to the middle zone target temperature.

4. The method of claim 1, wherein the edge zone maximum temperature is equal to the middle zone maximum temperature.

5. The method of claim 1, wherein the micro fluid ejection device has only two edge zones and only one middle zone.

6. The method of claim 1, wherein the micro fluid ejection device has multiple edge zones and multiple middle zones.

7. The method of claim 1, wherein the edge zone epsilon temperature is higher than the middle zone epsilon temperature.

8. The method of claim 1, wherein the edge zone target temperature is higher than the middle zone target temperature.

9. The method of claim 1, wherein the edge zone maximum temperature is higher than the middle zone maximum temperature.

10. A micro fluid ejection device comprising:

at least one middle zone, wherein the middle zone is disposed relatively nearer a middle portion of the micro fluid ejection device, a middle zone heater associated with the middle zone, for heating the middle zone, a middle zone temperature sensor associated with the middle zone, for sensing a middle zone temperature, a middle zone controller for controlling a middle zone power that is applied to the middle zone heater based at least in part on the middle zone temperature, the middle zone controller having set points including a middle zone epsilon temperature, a middle zone target temperature, and a middle zone maximum temperature, the middle controller having circuitry to, apply a full middle zone power to the middle zone heater when the middle zone temperature is below the middle zone epsilon temperature, apply less than the full middle zone power to the middle zone heater when the middle zone temperature is both above the middle zone epsilon temperature and below the middle zone target temperature, where the middle zone power applied is calculated to achieve the middle zone target temperature, and apply no power to the middle zone heater when the middle zone temperature is above the middle one target temperature, at least one edge zone, wherein the edge zone is disposed relatively nearer an edge portion of the micro fluid ejection device, an edge zone heater associate with the edge zone, for heating the edge zone, an edge zone temperature sensor associated with the edge zone, for sensing an edge zone temperature, and an edge zone controller for controlling an edge zone power that is applied to the edge zone heater based at least in part on the edge zone temperature, the edge zone controller having set points including an edge zone epsilon temperature, an edge zone target temperature, and an edge zone maximum temperature, the edge controller having circuitry to, apply a full edge zone power to the edge zone heater when the edge zone temperature is below the edge zone epsilon temperature, apply less than the full edge zone power to the edge zone heater when the edge zone temperature is both above the edge zone epsilon temperature and below the edge zone target temperature, wherein the edge zone power applied is calculated to achieve the edge zone target temperature, apply no power to the edge zone heater when the edge zone temperature is above the edge zone maximum temperature, and when the edge zone temperature is both above the edge zone target temperature and below the edge zone maximum temperature, apply no power to the edge zone heater when the middle zone temperature is below the middle zone target temperature, and apply less than the full edge power to the edge zone heater when the middle zone temperature is both above the middle zone target temperature and below the middle zone maximum temperature, wherein the edge power applied is calculated to achieve the middle zone temperature.

11. The micro fluid ejection device of claim 10, wherein the edge zone epsilon temperature is equal to the middle zone epsilon temperature the edge zone target temperature is equal to the middle zone target temperature, and the edge zone maximum temperature is equal to the middle zone maximum temperature.

12. The micro fluid ejection device of claim 10, wherein the micro fluid ejection device has two edge zones for every one middle zone.

13. The micro fluid ejection device of claim 10, wherein the micro fluid ejection device has a plurality of edge zones and a plurality of middle zones.

14. The micro fluid ejection device of claim 10, wherein the edge zone epsilon temperature is greater than the middle zone epsilon temperature.

15. The micro fluid ejection device of claim 10 wherein the edge zone target temperature is greater than the middle zone target temperature.

16. The micro fluid ejection device of claim 10, wherein the edge zone maximum temperature is greater than the middle zone maximum temperature.

17. A method of controlling a micro fluid ejection device having at least a middle zone with an associated middle zone heater and an edge zone with an associated edge zone heater wherein the middle zone is disposed relatively nearer a middle portion of a substrate for the micro fluid ejection device and the edge zone is disposed relatively nearer an edge portion of the substrate for the micro fluid ejection device, the method comprising the step of:

specifying a middle zone epsilon temperature a middle zone target temperature, and a middle zone maximum temperature, sensing temperature in the middle zone to produce a middle zone temperature, applying a full middle zone power to the middle zone heater when the middle zone temperature is below the middle zone epsilon temperature, applying less than the full middle zone power to the middle zone heater when the middle zone temperature is both above the middle zone epsilon temperature and below the middle zone target temperature, applying no power to the middle zone heater when the middle zone temperature is above the middle zone target temperature, specifying an edge zone epsilon temperature, an edge zone target temperature, and an edge zone maximum temperature, sensing temperature in the edge zone to produce an edge zone temperature, applying a full edge zone power to the edge zone heater when the edge zone temperature is below the edge zone epsilon temperature, applying less than the full edge zone power to the edge zone heater when the edge zone temperature is both above the edge zone epsilon temperature and below the edge zone target temperature, and applying no power to the edge zone heater when the edge zone temperature is above the edge zone maximum temperature.

18. The method of claim 17, wherein applying less than the full middle zone power to the middle zone heater when the middle zone temperature is both above the middle zone epsilon temperature and below the middle zone target temperature, comprises applying the middle zone power at an amount calculated to achieve the middle zone target temperature.

19. The method of claim 17, wherein applying less than the full edge zone power to the edge zone heater when the edge zone temperature is both above the edge zone epsilon temperature and below the edge zone target temperature, comprises applying the edge zone power at an amount calculated to achieve the edge zone target temperature.

20. The method of claim 17, further comprising when the edge zone temperature is both above the edge zone target temperature and below the edge zone maximum temperature, applying no power to the edge zone heater when the middle zone temperature is below the middle zone target temperature, and applying less than the full edge zone power to the edge zone heater when the middle zone temperature is both above the middle zone target temperature and below the middle zone maximum temperature, wherein the edge zone power applied is calculated to achieve the middle zone temperature.

* * * * *